US008763320B1

(12) United States Patent
Chou et al.

(10) Patent No.: US 8,763,320 B1
(45) Date of Patent: Jul. 1, 2014

(54) DUAL-CORE SELF-CENTERING BUCKLING-RESTRAINED BRACE

(71) Applicant: National Applied Research Laboratories, Taipei (TW)

(72) Inventors: Chung-Che Chou, Taipei (TW); Ping-Ting Chung, Tainan (TW); Wen-Jing Tsai, Taipei (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 14/019,652

(22) Filed: Sep. 6, 2013

(30) Foreign Application Priority Data

Mar. 1, 2013 (TW) ..... 102107173 U

(51) Int. Cl.

| | |
|---|---|
| ***E04B 1/98*** | (2006.01) |
| ***E04H 9/00*** | (2006.01) |
| ***E04B 2/78*** | (2006.01) |
| ***E04C 3/00*** | (2006.01) |
| ***E04H 12/16*** | (2006.01) |

(52) U.S. Cl.

CPC .. *E04H 9/00* (2013.01); *E04B 2/78* (2013.01); *E04B 1/98* (2013.01); *E04C 3/00* (2013.01); *E04H 12/16* (2013.01)

USPC ..... 52/167.3; 52/167.7; 52/167.8; 52/223.8

(58) Field of Classification Search

CPC ..... E04B 1/18; E04B 1/22; E04B 1/36; E04B 1/98; E04B 2/78; E04C 3/00; E04C 5/08; E04G 21/12; E04H 7/20; E04H 9/02; E04H 12/16

USPC ..... 52/1, 167.1, 167.3, 167.4, 167.7–9, 52/223.1, 223.4, 223.8, 223.13, 834, 843

See application file for complete search history.

(56) References Cited

U.S. PATENT DOCUMENTS

| | | | | |
|---|---|---|---|---|
| 4,313,287 | A * | 2/1982 | Romig, Jr. | 52/223.4 |
| 7,185,462 | B1 * | 3/2007 | Smelser | 52/167.3 |
| 7,305,799 | B2 * | 12/2007 | Smelser et al. | 52/167.3 |
| 7,373,758 | B2 * | 5/2008 | Tsai et al. | 52/834 |
| 7,762,026 | B2 * | 7/2010 | Smelser | 52/167.3 |
| 8,250,818 | B2 * | 8/2012 | Tremblay et al. | 52/167.3 |
| 8,316,589 | B2 * | 11/2012 | Chou et al. | 52/167.1 |
| 2006/0101733 | A1 * | 5/2006 | Jen et al. | 52/167.1 |
| 2008/0083173 | A1 * | 4/2008 | Smelser | 52/167.1 |
| 2012/0000147 | A1 | 1/2012 | Chou et al. | |
| 2012/0266548 | A1 * | 10/2012 | Tremblay et al. | 52/167.3 |

* cited by examiner

*Primary Examiner* — William Gilbert
*Assistant Examiner* — Patrick Maestri
(74) *Attorney, Agent, or Firm* — McNees Wallace & Nurick LLC

(57) ABSTRACT

A dual-core self-centering buckling-restrained brace includes a core unit, a restraining unit clamping the core unit therein, a middle sleeve disposed around the an energy dissipating section of the core unit and the restraining unit and having an end welded to one end of the core unit, an outer sleeve disposed around the middle sleeve and having an end welded to the other end of the core unit, two inner plates disposed respectively at two ends of the restraining unit, two outer plates disposed respectively at two ends of each of the middle sleeve and said outer sleeve, at least one first tensing member connecting the first inner plate to the second outer plate, and at least one second tensioning element connecting the first outer plate to the second inner plate.

12 Claims, 18 Drawing Sheets

DUAL-CORE SELF-CENTERING BUCKLING-RESTRAINED BRACE

CROSS-REFERENCE TO RELATED APPLICATION

This application claims priority of Taiwanese Application No. 102107173, filed on Mar. 1, 2013.

BACKGROUND OF THE INVENTION

1. Field of the Invention

This invention relates to a buckling-restrained brace, and more particularly to a dual-core self-centering buckling-restrained brace capable of increasing the amount in a change of the length of the apparatus and preventing buckling of a core unit.

2. Description of the Related Art

US 2012/0000147 discloses a dual-core self-centering energy dissipation brace apparatus, which includes a first core member configured as a rectangular steel tube, a second core member configured as a rectangular steel tube and disposed within the first core member, two inner abutment plates disposed respectively at two ends of the second core member, an outer sleeve disposed around the first core member and configured as a rectangular steel tube, two outer abutment plates disposed respectively at two ends of the outer sleeve, and two tensioning units. One of the tensioning units connects one of the inner abutment plates corresponding to one end of the outer sleeve to one of the outer abutment plates corresponding to the other end of the outer sleeve. The other of the tensioning units connects the other of the inner abutment plates to the other of the outer abutment plates. The first core member is provided with a plurality of energy dissipating plates. The outer sleeve is provided with angle steels connected to the energy dissipating plates by lock bolts for energy dissipating purposes.

When an external force is applied to the apparatus, it is transmitted from a building onto the first core member or one of the outer abutment plates, and is transmitted out along a path including one of the tensioning units, one of the inner abutment plates, the second core member, the other of the inner abutment plates, the other of the tensioning units, the other of the outer abutment plates, and the outer sleeve. During the transmission of the external force, relative movement occurs among the first and second core members and the outer sleeve, such that energy is dissipated through the energy dissipating plates, the angle steels, and the lock bolts. In addition, each of the tensioning units has an elongation amount δ, so that the first core member and the outer sleeve move relative to each other by a distance 2δ. Hence, the maximum allowable elongation amount of the apparatus when subjected to an earthquake is increased. In this manner, energy can be dissipated through friction.

Upon occurrence of an earthquake, the residue stress of the building can be eliminated by return force of the tensioning units. However, when the apparatus is subjected to a plurality of earthquakes, such energy dissipating members (including the energy dissipating plates, the angle steels, and the lock bolts) experience serious wear, which reduces their energy dissipating efficiency and results in a need for frequent replacement, maintenance, and repair.

SUMMARY OF THE INVENTION

The object of this invention is to provide a dual-core self-centering buckling-restrained brace that can overcome the drawbacks associated with the prior art.

According to this invention, a dual-core self-centering buckling-restrained brace includes a core unit, a restraining unit clamping the core unit therein, a middle sleeve disposed around an energy dissipating section of the core unit and the restraining unit and having an end welded to one end of the core unit, an outer sleeve disposed around the middle sleeve and having an end welded to the other end of the core unit, two inner plates disposed respectively at two ends of the restraining unit, two outer plates disposed respectively at two ends of each of the middle sleeve and the outer sleeve, at least one first tensing member connecting the first inner plate to the second outer plate, and at least one second tensioning element connecting the first outer plate to the second inner plate.

Unlike the above-mentioned prior art, the earthquake energy is dissipated by the energy-dissipating section of the core unit, and the buckling of the core unit is prevented by the retraining unit, so that the energy-dissipating efficiency of the apparatus can be promoted effectively.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
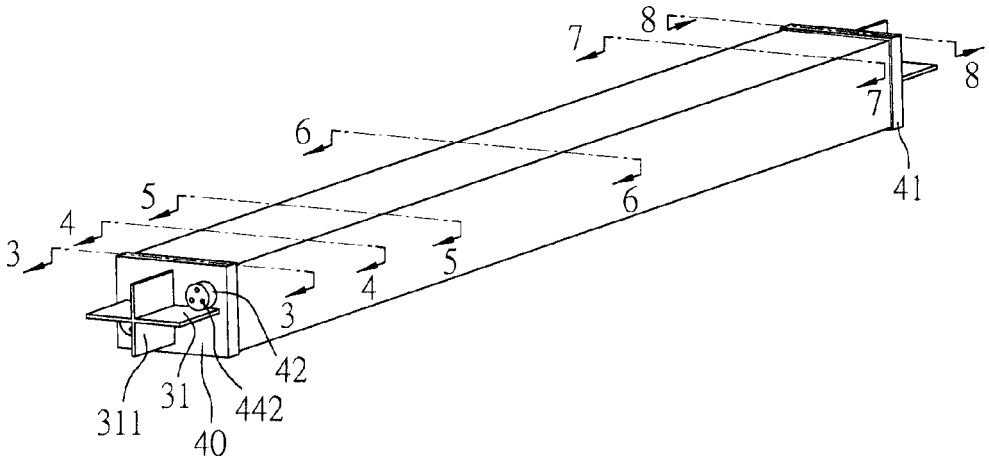
FIG. 1 is a perspective view of the first preferred embodiment of a dual-core self-centering buckling-restrained brace according to this invention.

Before the present invention is described in greater detail in connection with the preferred embodiments, it should be noted that similar elements and structures are designated by like reference numerals throughout the entire disclosure.

Referring to FIGS. 1 to 8, the first preferred embodiment of a dual-core self-centering buckling-restrained brace according to this invention includes an elongate core unit 31, a restraining unit 32 disposed around the core unit 31, an inner sleeve 37 disposed around the restraining unit 32, first and second inner plates 36 adjacent respectively to two ends of the inner sleeve 37 such that the inner sleeve 37 is disposed between the first and second inner plates 35, 36, a middle sleeve 38 disposed around the inner sleeve 37, an outer sleeve 39 disposed around the middle sleeve 38 and the inner sleeve 37, first and second outer plates 40, 41 adjacent respectively to two ends of each of the middle sleeve 38 and the outer sleeve 39 such that the middle sleeve 38 and the outer sleeve 39 are disposed between the first and second outer plates 40, 41, a plurality of first tensioning elements 441, a plurality of second tensioning elements 442, and first and second fastening units 42, 43. The first and second tensioning elements 441, 442 are made of a stretchable material, such as a fiber composite material, a twisted steel wire, a steel bar, or an alloy bar.

The core unit 31 includes a main body 310 configured as a horizontal plate. The main body 310 has opposite first and second coupling end sections 310A, 310B, and an energy dissipating section 310C connected between the first and second coupling end sections 310A, 310B. Each of the first and second coupling end sections 310A, 310B has a trapezoidal middle portion 310A', 310B' and a uniform-width connecting portion 310A", 310B". The middle portion 310A', 310B' has a width that reduces gradually in a direction toward the energy dissipating section 310C. The uniform-width connecting portion 310A", 310B" is connected to an end of the middle portion 310A', 310B' distal from the energy dissipating section 310C, is in contact with and welded to a corresponding one of the middle and outer sleeves 38, 39, and has a width equal to the maximum width of the middle portion 310A', 310B'. The core unit 31 further includes two vertical left reinforcing plates 311 welded respectively to horizontal top and bottom surface of the first coupling end sections 310A and having a middle portion extending across the trapezoidal middle portion of the first coupling end section 310A, and two vertical right reinforcing plates 312 welded respectively to the horizontal top and bottom surfaces of the second coupling end section 310B and having a middle portion extending across the trapezoidal middle portion 310B' of the second coupling end section 310B. The left and right reinforcing plates 311, 312 cooperate with the first and second coupling end sections 310A, 310B to connect with the building. An end of the core unit 31 corresponding to the first coupling end 310A extends through cross-shaped accommodating spaces 400, 350 in the first outer plate 40 and the first inner plate 35. An opposite end of the core unit 31 corresponding to the second coupling end 310B extends through accommodating spaces 410, 360 in the second outer plate 41 and the second inner plates 36. Before the first and second inner plates 35, 36 are assembled to the core unit 31, each of the first and second inner plates 35, 36 includes two plate halves 35', 36' that are welded to each other after they are moved to predetermined positions on the core plate 31. Each of the cross-shaped accommodating spaces 350, 360 is defined between the corresponding plate halves 35', 36'.

The restraining unit 32 includes upper and lower channel members 321, 321' arranged one above another and opened toward each other, two horizontal steel plates 323 disposed between and welded respectively to the upper and lower channel members 321, 321', and two cushioning plates 33 disposed between the steel plates 322 and abutting respectively against two opposite sides of each of the steel plates 322. The channel members 321, 321' have a rectangular cross-section. The steel plates 322 and the cushioning plates 323 are interconnected by bolts 34 in such a manner to clamp the cushioning plates 323 between the steel plates 322. The upper and lower channel members 321, 321' can be filled with cement paste or concrete to promote the restraining effect.

The inner sleeve 37 is configured as a rectangular steel tube. The first and second inner plates 35, 36 are welded respectively to left and right ends of the inner sleeve 37. Each of the first and second inner plates 35, 36 is adjacent to a junction between the energy dissipating section 310C and a corresponding one of the first and second coupling end sections 310A, 310B. The main body 310 extends through the cross-shaped accommodating spaces 350, 360.

The middle sleeve 38 is configured as a rectangular steel tube, and is disposed around the energy dissipating section 310C. An end of the middle sleeve 38 corresponding to the second coupling end section 310B is formed with a plurality of open-ended slots 381. The second coupling end section 310B and the right reinforcing plates 312 extend respectively through the open-ended slots 381.

Figure 8:
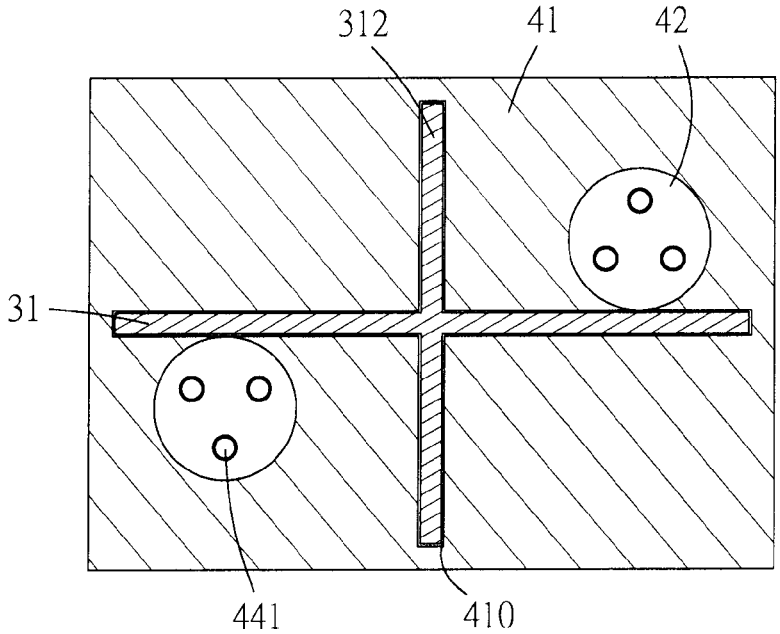
Figure 8A:
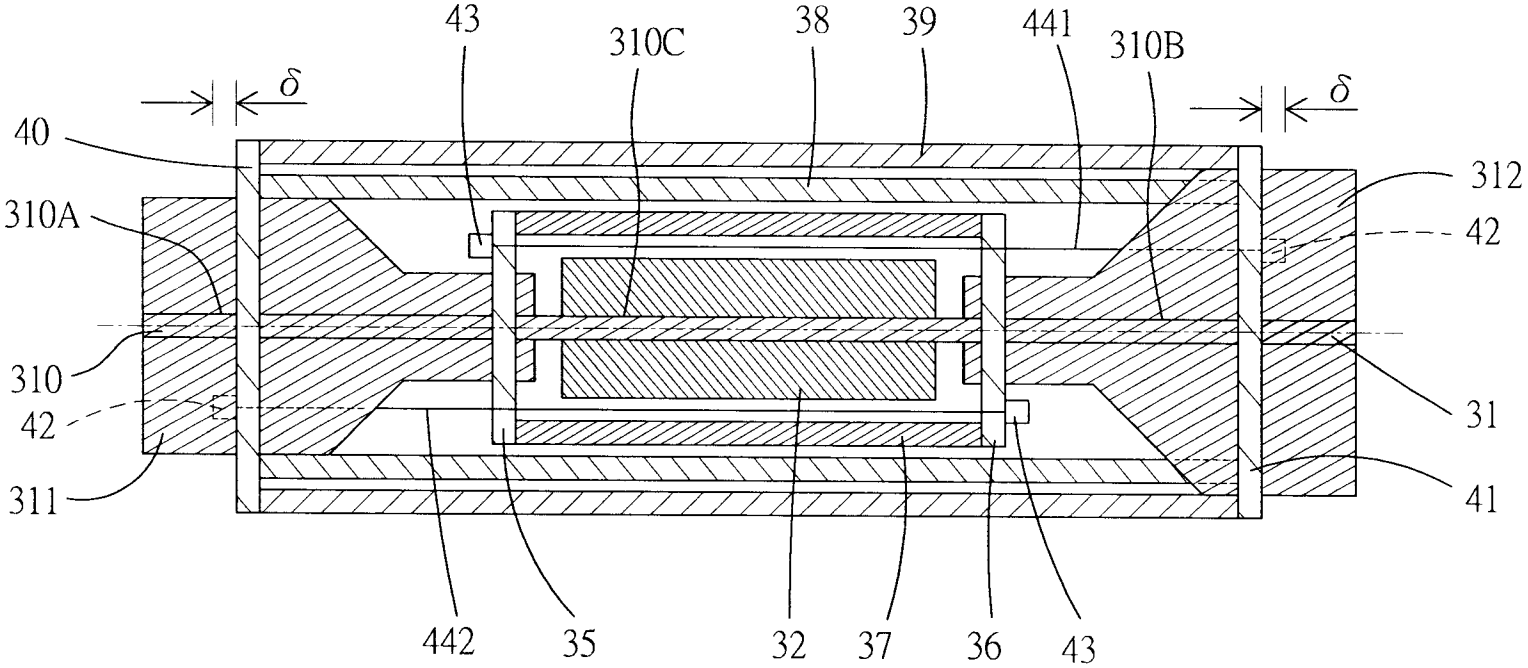
FIG. 8A is a schematic view illustrating the mechanical performances of the components of the first preferred embodiment when no external force is applied to the apparatus.

With particular reference to FIG. 8A, when no external force is applied to the apparatus, left and right ends of the outer sleeve 39 are aligned respectively with those of the middle sleeve 38, and the first and second outer plates 40, 41 abut respectively against two ends of each of the middle and outer sleeves 38, 39.

The first coupling end section 310A of the main body 310 of the core unit 31 is welded to the middle sleeve 38. The second coupling end section 310B of the main body 31 is welded to the outer sleeve 30. In this embodiment, each of the left reinforcing plates 311 have a vertical width smaller than that of each of the right reinforcing plates 312, and is in contact with the middle sleeve 38, while each of the right reinforcing plates 312 is in contact with the outer sleeve 39.

Figure 6:
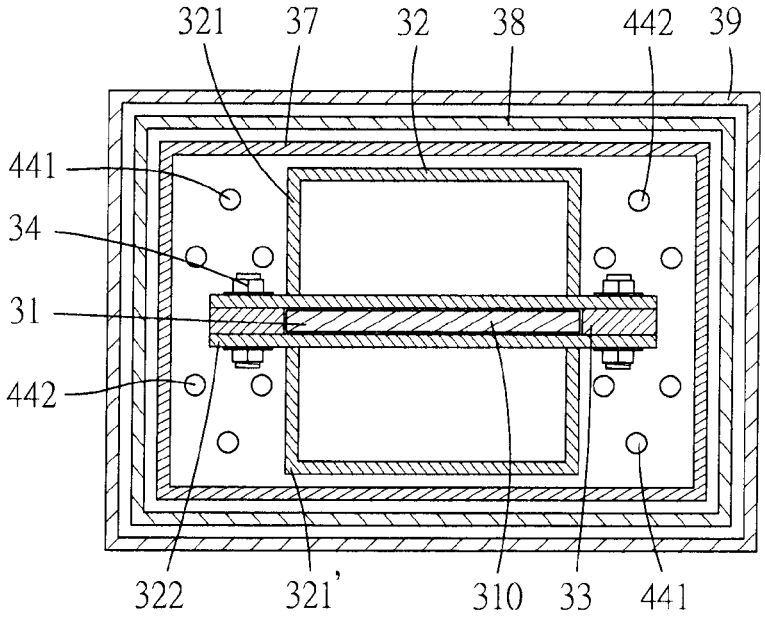
Figure 7:
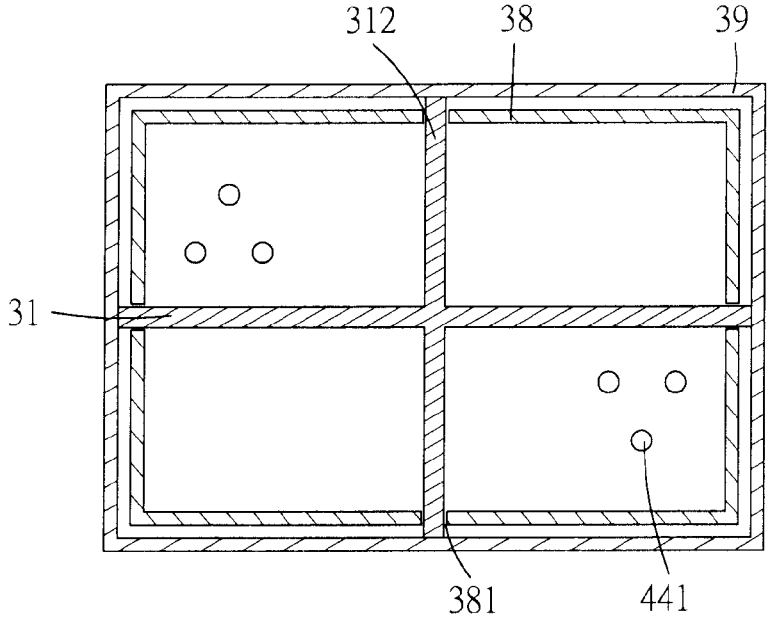

The first and second tensioning elements 441, 442 extend along a longitudinal direction of the core unit 31. In this embodiment, the number of the first tensioning elements 441 is six, and the number of the second tensioning elements 442 is also six. With particular reference to FIG. 6, three of the first tensioning elements 441 are disposed between the upper channel member 321 and the inner sleeve 37, and the remaining first tensioning elements 441 are disposed between the lower channel member 321' and the inner sleeve 37. Each of the first tensioning elements 441 has two ends fastened respectively to the first inner plate 35 and the second outer plate 41 by the first and second fastening units 42, 43, so that the first tensioning elements 441 are prestressed. Three of the second tensioning elements 442 are disposed between the upper channel member 321 and the inner sleeve 37, and the remaining first tensioning elements 441 are disposed between the lower channel member 321' and the inner sleeve 37. Each of the second tensioning elements 442 has two ends fastened respectively to the second inner plate 36 and the first outer plate 40 by the fastening units 42, 43, so that the second tensioning elements 442 are prestressed.

It should be noted that, the number and arrangement of the first and second tensioning elements 441, 442 may be changed.

Figure 2:
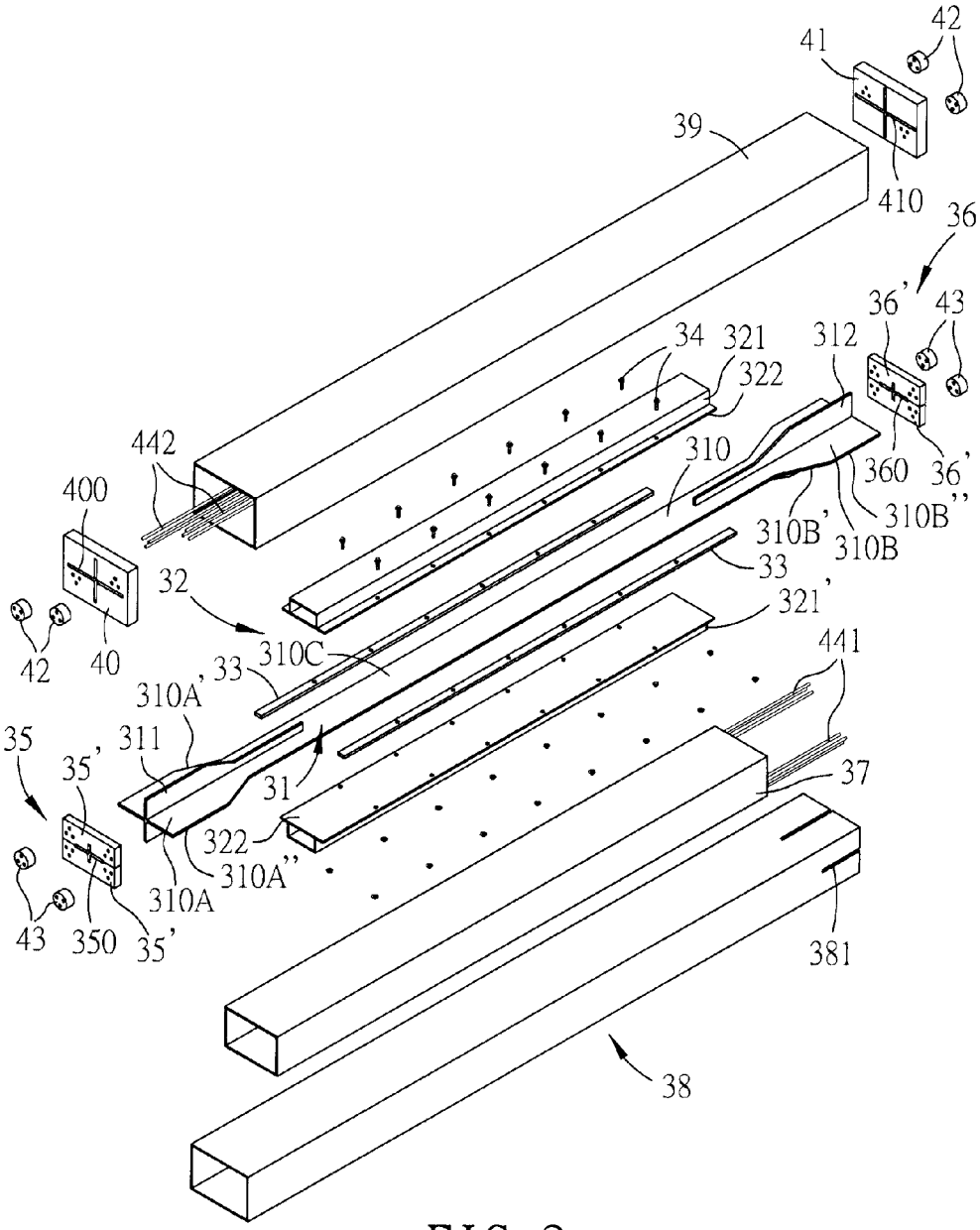
FIG. 2 is a partly exploded perspective view of the first preferred embodiment.
Figure 3:
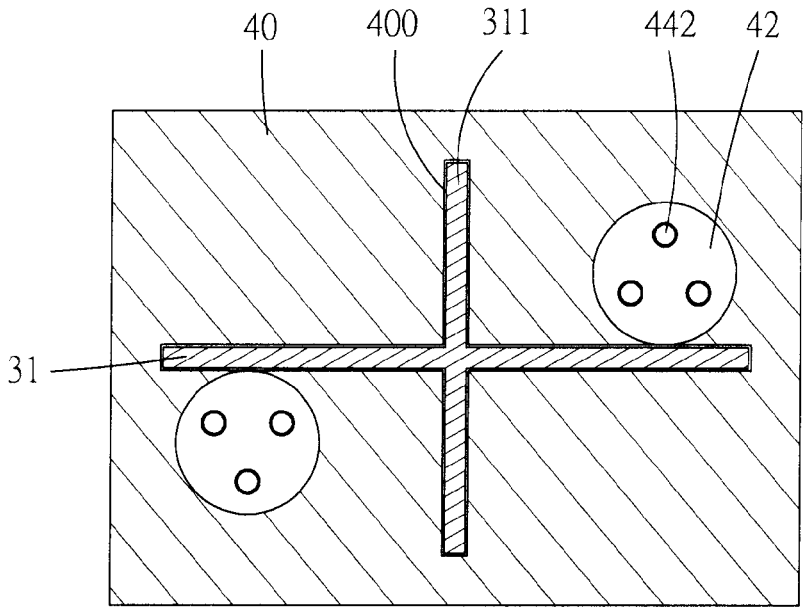
FIGS. 3, 4, 5, 6, 7, and 8 are sectional views taken respectively along lines 3-3, 4-4, 5-5, 6-6, 7-7, and 8-8 in FIG. 1.
Figure 4:
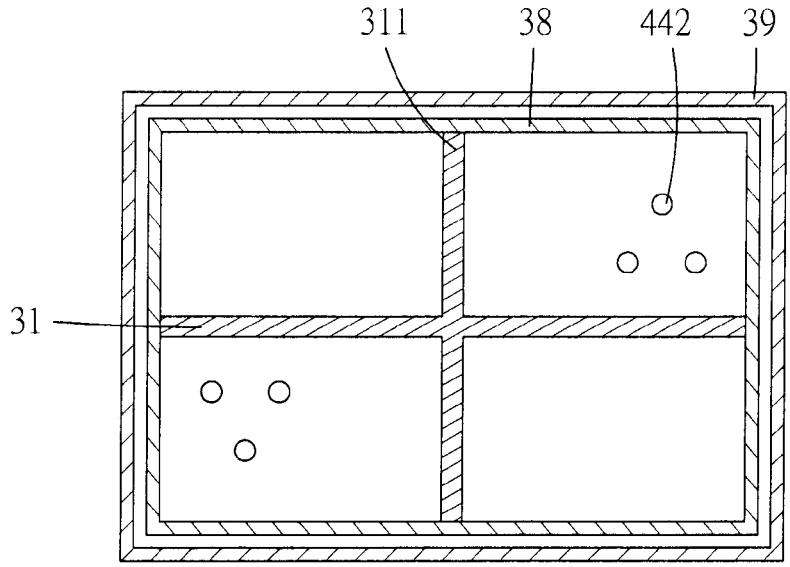
Figure 5:
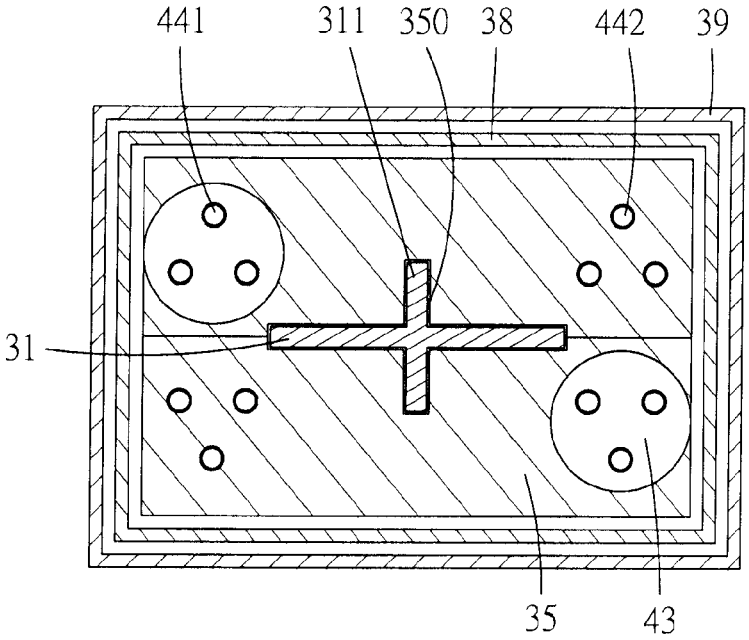
Figure 9:
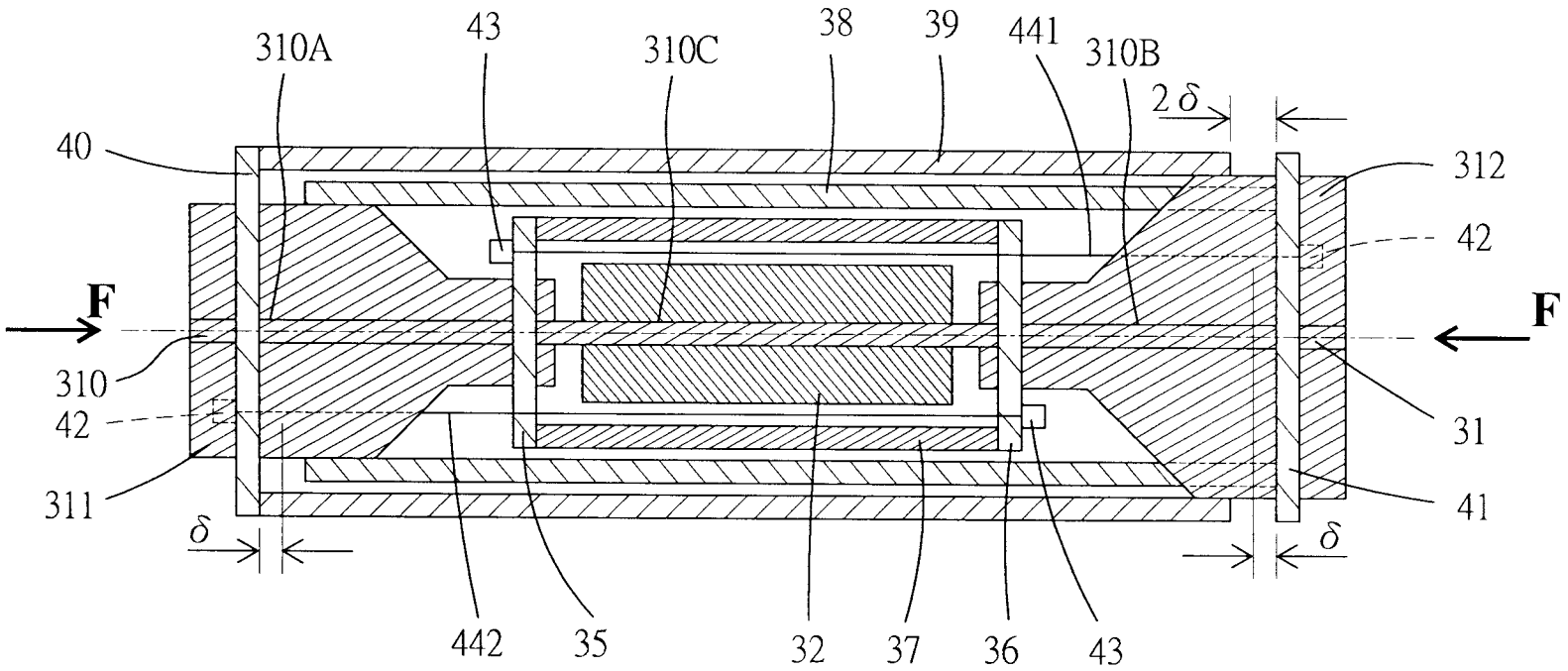
FIGS. 9 and 10 are schematic views illustrating the mechanical performances of the components of the first preferred embodiment when subjected to a pushing force and a pulling force, respectively.

With particular reference to FIGS. 2 and 9, when a pushing force is applied to the apparatus, it can be transmitted along a path including the first coupling end section 310A of the core unit 31, the middle sleeve 38, the second outer plate 41, the first tensioning elements 441, the first inner plate 35, the inner sleeve 37, the second inner plate 36, the second tensioning elements 442, the first outer plate 40, and the outer sleeve 39.

Subsequently, the force is transmitted out through the second coupling end section 310B of the core unit 31. Hence, the first outer plate 40 is separated from the middle sleeve 38, the second outer plate 41 is separated from the outer sleeve 39, and relative movement occurs among the inner, middle, and outer sleeves 37, 38, 39, such that the length of each of the first and second tensioning elements 441, 442 is increased by an amount δ. As a result, the middle sleeve 38 and the outer sleeve 39 are moved relative to each other by a distance 2δ, and the length of the core unit 31 is reduced by an amount 2δ.

During this procedure, the core unit 31 can dissipate the earthquake energy by compression of the energy dissipating section 310C, and the restraining unit 32 can prevent the core unit 31 from buckling. In this embodiment, the inner sleeve 37 is clamped between the first and second inner plates 35, 36, and the restraining unit 32 bears against a lateral force generated due to buckling of the energy dissipating section 310C.

Figure 10:
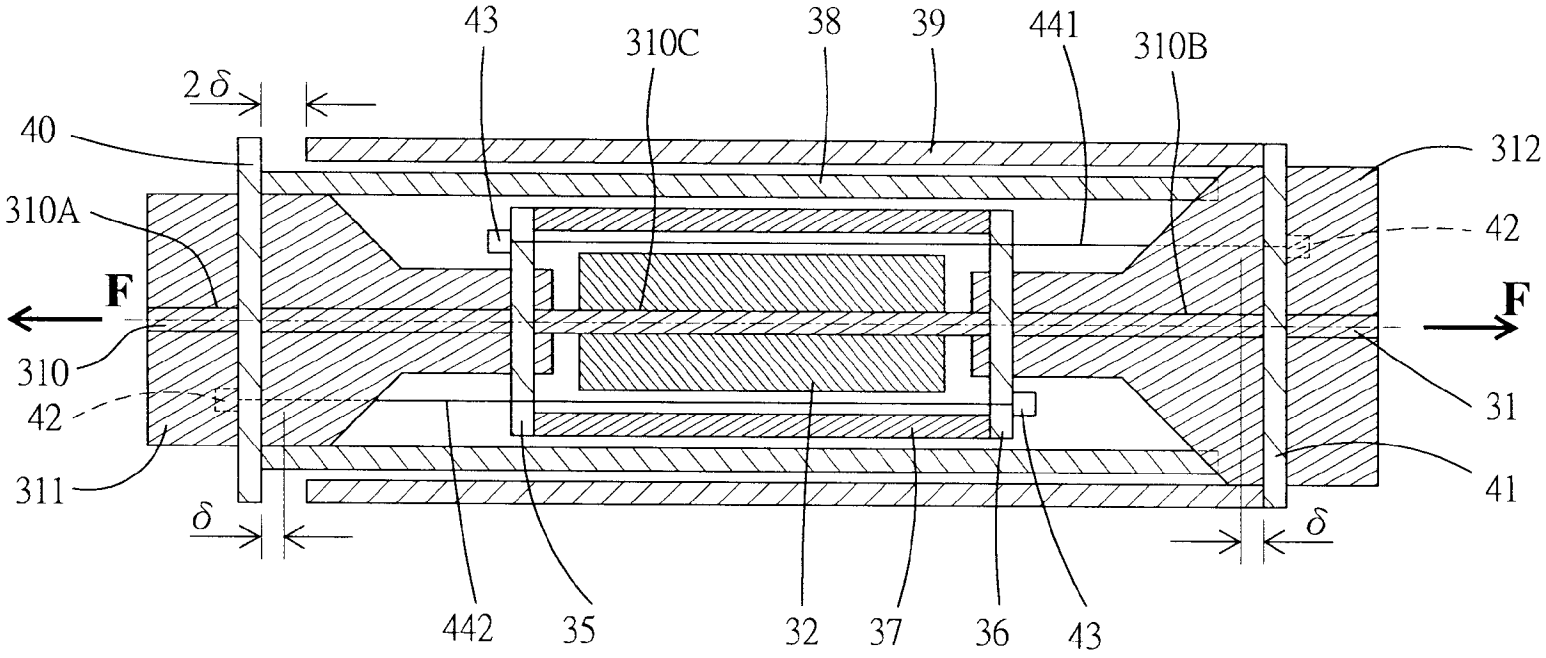

With particular reference to FIGS. 2 and 10, when a pulling force is applied to the apparatus, it can be transmitted along a path including the first coupling end section 310A of the core unit 31, the first outer plate 40, the second tensioning elements 442, the second inner plate 36, the inner sleeve 37, the first inner plate 35, the first tensioning elements 441, the second outer plate 41, and the outer sleeve 39. The force is transmitted out through the second coupling end section 310B of the core unit 31. Hence, the first outer plate 40 is separated from the outer sleeve 39, the second outer plate 41 is separated from the middle sleeve 38, and relative movement occurs among the inner, middle, and outer sleeves 37, 38, 39, so that the core unit 31 can dissipate the earthquake energy by tension of the energy dissipating section 310C, and the restraining unit 32 can prevent the core unit 31 from buckling. During this procedure, the length of each of the first and second tensioning elements 441, 442 is increased by an amount δ. As a result, the middle sleeve 38 and the outer sleeve 39 are moved relative to each other by a distance 2δ, and the length of the core unit 31 is increased by an amount 2δ.

Figure 11:
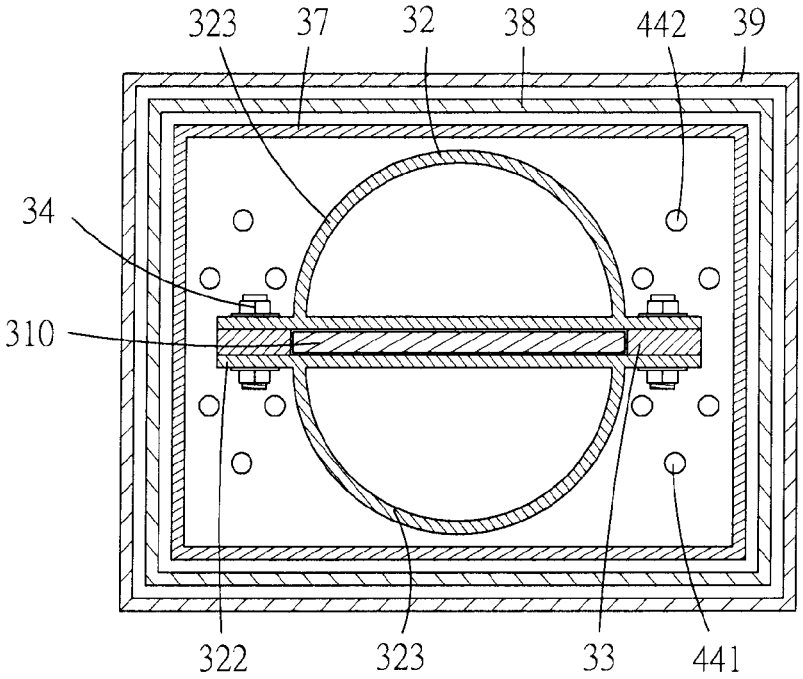
FIG. 11 is a sectional view of the second preferred embodiment of a dual-core self-centering energy dissipating apparatus according to this invention.

FIG. 11 shows the second preferred embodiment of a dual-core self-centering buckling-restrained brace according to this invention, which differs from the first preferred embodiment in that the channel members 323 has a semicircular cross-section. Alternatively, the cross-section may be of other shape, e.g., triangular.

Figure 12:
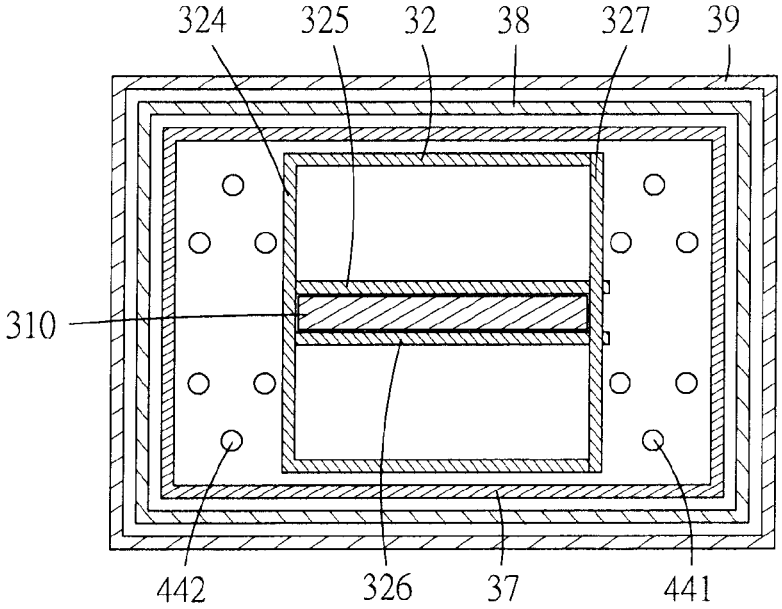
FIG. 12 is a sectional view of the third preferred embodiment of a dual-core self-centering energy dissipating apparatus according to this invention.

FIG. 12 shows the third preferred embodiment of a dual-core self-centering buckling-restrained brace according to this invention, which is similar to the first preferred embodiment. Unlike the first preferred embodiment, the restraining unit 32 includes a channel member 324 having a rectangular cross-section and permitting the core unit 31 to be disposed therein, two steel plates 325, 326 abutting respectively against top and bottom surfaces of the main body 310 and each having an inner end (i.e., left end) welded to an inner surface of the channel member 324, and an outer end (i.e., right end) extending outwardly from an right end opening in the channel member 324, and a cover plate 327 sealing the opening in the channel member 324. As such, the core unit 31 is clamped between the steel plates 325, 326. The cover plate 327 is formed with two slots permitting the outer ends of the steel plates 325, 326 to extend therethrough, and is welded to the steel plates 325, 326 and the channel member 324. Similar to the first preferred embodiment, the channel member 324 can be filled with cement paste or concrete.

FIGS. 13 to 20 show the fourth preferred embodiment of a dual-core self-centering buckling-restrained brace according to this invention, which differs from the first preferred embodiment in the following.

Figure 18:
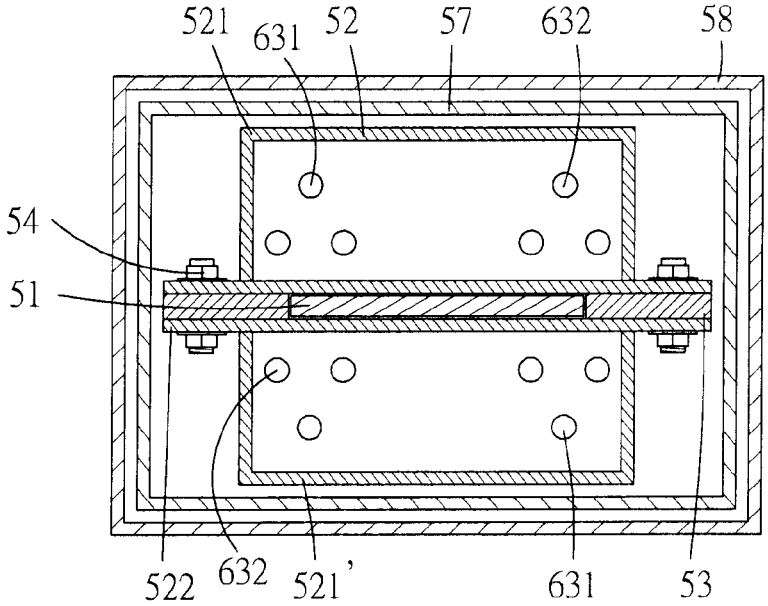
Figure 19:
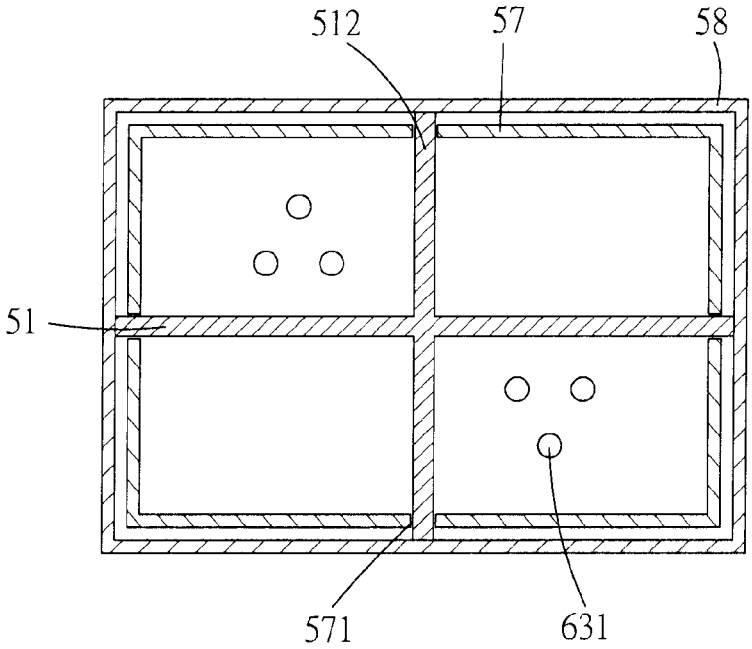

In this embodiment, the inner sleeve 37 is omitted, and the first and second inner plates 55, 56 are welded respectively to two ends of the restraining unit 52. The left reinforcing plates 511 are shortened, and have right ends aligned with the right end of the trapezoidal middle portion 510A' of the first coupling end section 510A. The right reinforcing plates 512 are also shortened, and have left ends aligned with the left end of the trapezoidal middle portion 510B' of the second coupling end section 510B. As such, since each of the first and second inner plates 55, 56 consists of two plate halves 55', 56' welded to each other, and since the first and second inner plates 55, 56 are disposed respectively on portions of the first and second coupling end sections 510A, 510B that are not connected with the left and right reinforcing plates 511, 512, it is necessary for each of the first and second inner plates 55, 56 to be formed with only one straight slot 550, 560 for extension of a corresponding one of the first and second coupling end sections 510A, 510B. The straight slot 550, 560 is defined between the plate halves 55', 56'. This embodiment may be modified to shorten the restraining unit 52 and elongate the left and right reinforcing plates 511, 512 such that the left and right reinforcing plate 511, 512 extend respectively through the first and second inner plates 55, 56, so as to prevent buckling at positions whereat the restraining unit 52 is not disposed. In this situation, the accommodating spaces 550, 560 need to be cross-shaped for permitting the first and second reinforcing plates 511, 512 to extend respectively therethrough. In this embodiment, the accommodating spaces 590, 600 in the first and second outer plates 59, 60 are cross-shaped. The core unit 51 has a left end extending through the accommodating spaces 550, 590 in the first inner plate 55 and the first outer plate 59, and a right end extending through the accommodating spaces 560, 600 in the second inner plate 56 and the second outer plate 60. With particular reference to FIG. 18, three of the first tensioning elements 631 extend in the upper channel member 521, and the remaining three first tensioning elements 631 extend in the lower channel member 521'. Each of the first tensioning elements 631 has two ends fastened respectively to the first inner plate 55 and the second outer plate 60 by first and second fastening units 61, 62, and thus is prestressed. Three of the second tensioning elements 632 extend in the upper channel member 521, and the remaining three second tensioning elements 632 extend in the lower channel member 521'. Each of the second tensioning elements 632 has two ends fastened respectively to the first outer plate 59 and the second inner plate 56 by first and second fastening units 61, 62, and thus is prestressed.

Figure 13:
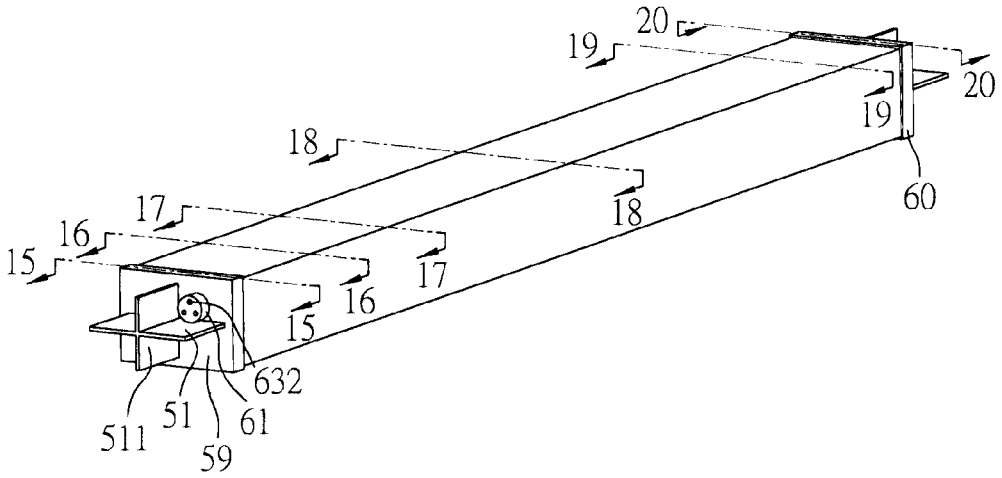
FIG. 13 is a perspective view of the fourth preferred embodiment of a dual-core self-centering buckling-restrained brace according to this invention.
Figure 14:
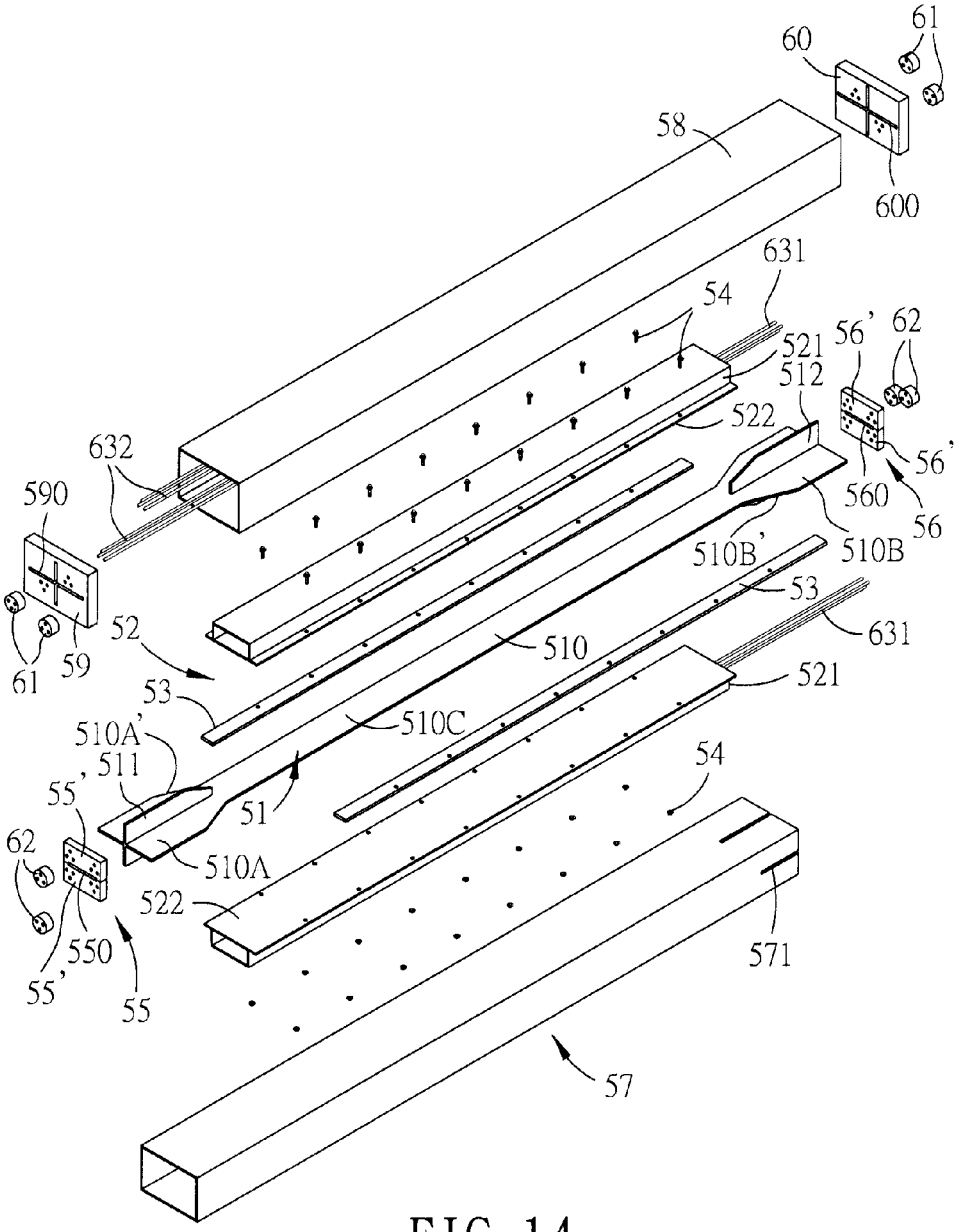
FIG. 14 is a partly exploded perspective view of the fourth preferred embodiment.
Figure 15:
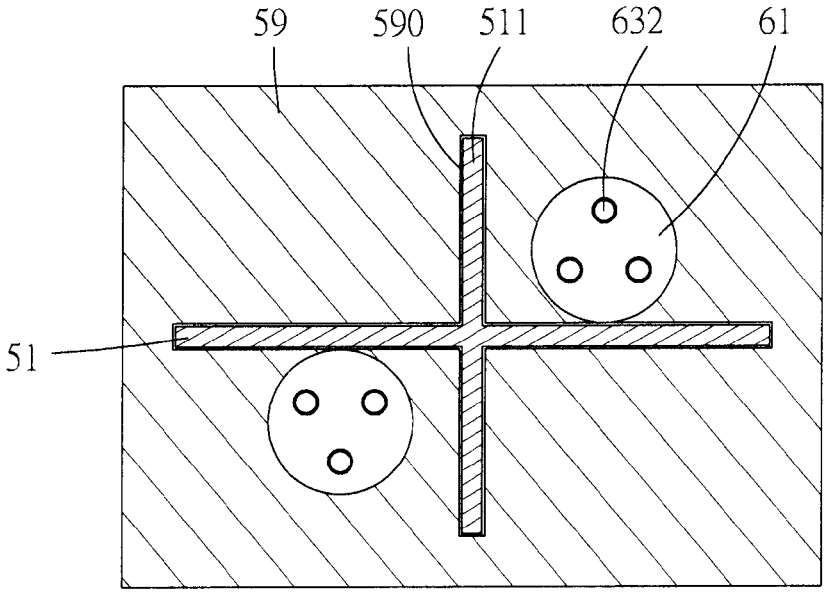
FIGS. 15,16, 17, 18, 19, and 20 are sectional views taken respectivelyalong lines 15-15, 16-16, 17-17, 18-18, 19-19, and 20-20 in FIG. 13.
Figure 16:
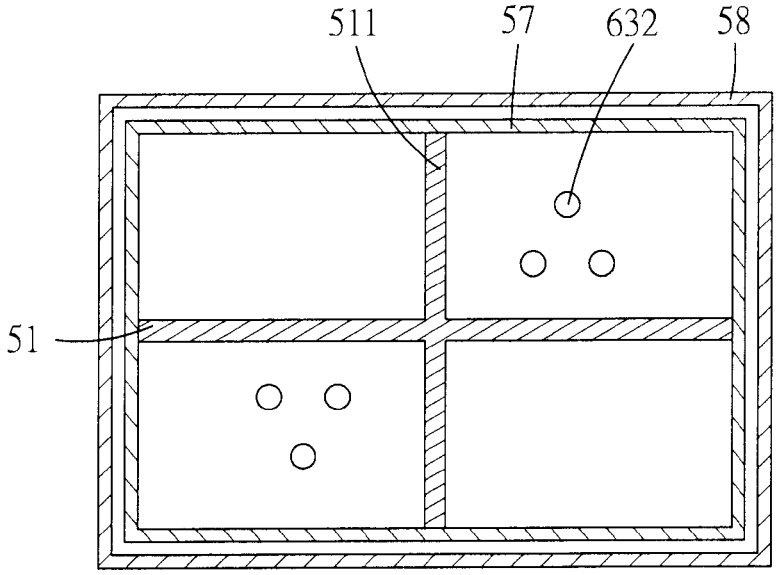
Figure 17:
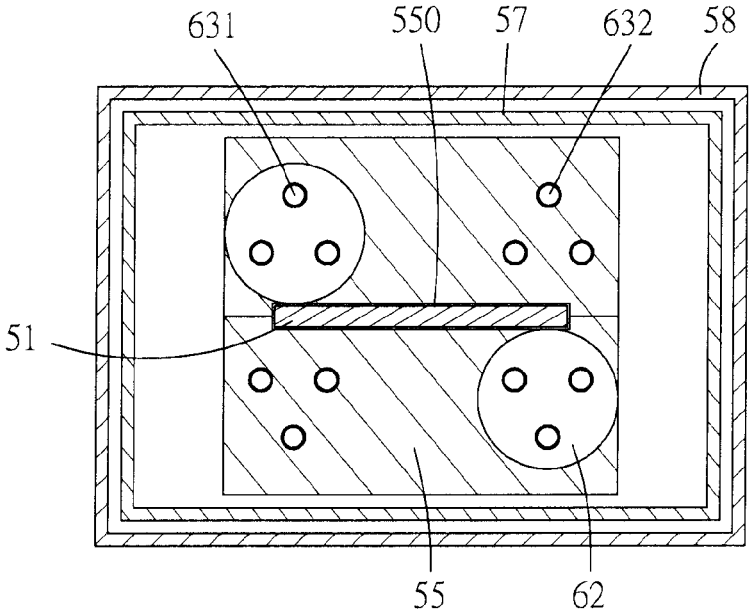
Figure 20:
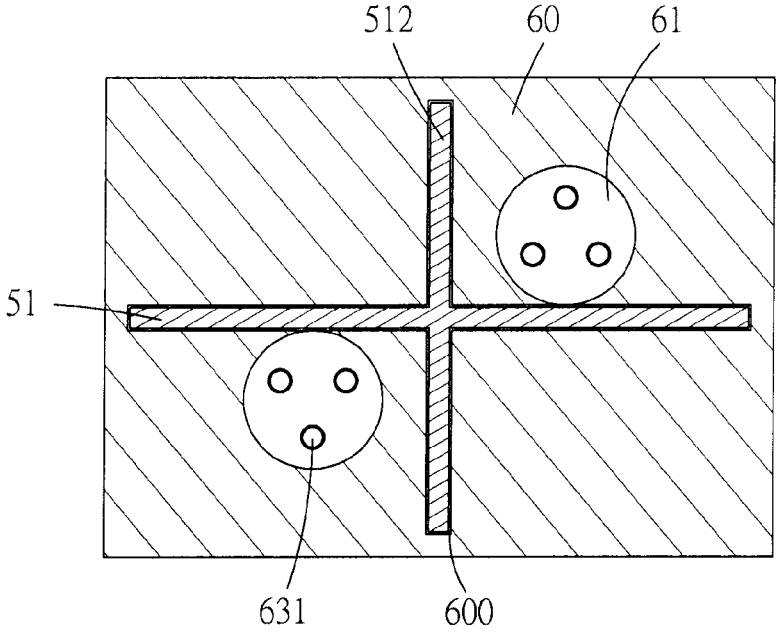
Figure 20A:
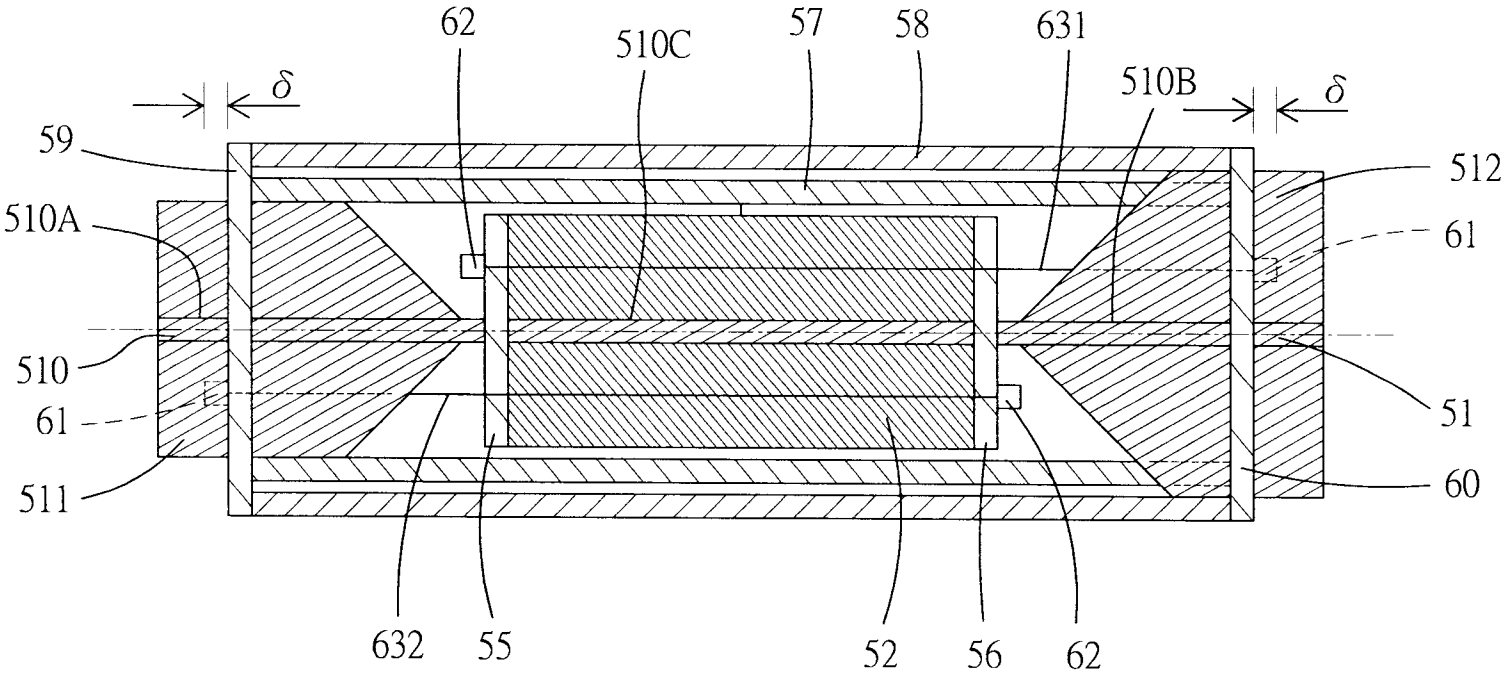
FIG. 20A is a schematic view illustrating the mechanical performances of the components of the second preferred embodiment when no external force is applied to the apparatus.

With particular reference to FIGS. 13 and 14, the first and second inner plates 55, 56 are welded respectively to two ends of the restraining unit 52. The first and second outer plates 59, 60 are disposed respectively at two ends of each of the outer sleeve 58 and the middle sleeve 57. With particular reference to FIG. 20A, when no external force is applied to the apparatus, two ends of the outer sleeve 58 are aligned respectively with two ends of the middle sleeve 57, and two ends of each of the middle and outer sleeves 57, 58 abut respectively against the first and second outer plates 59, 56.

Figure 21:
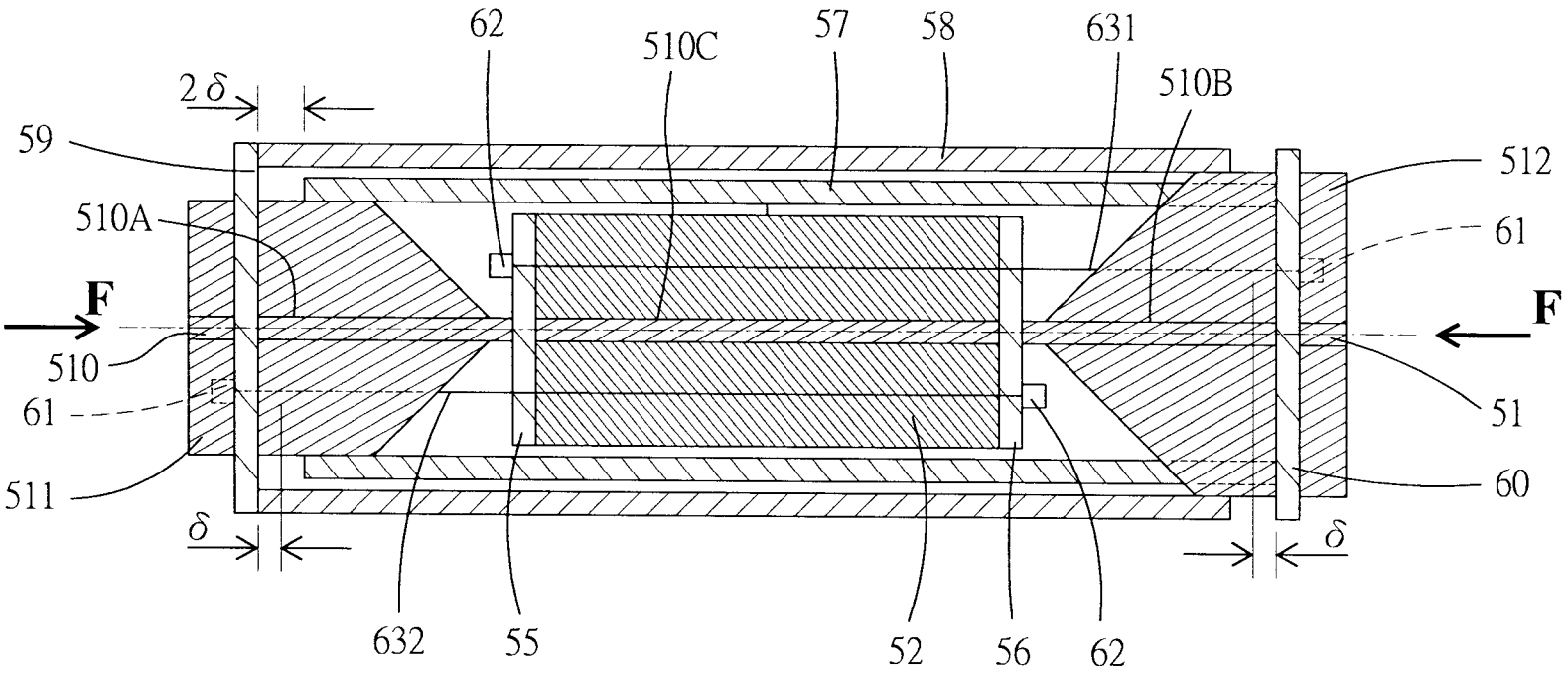
FIGS. 21 and 22 are schematic views illustrating the mechanical performances of the components of the fourth preferred embodiment when subjected to a pushing force and a pulling force, respectively.

With particular reference to FIGS. 14 and 21, when a pushing force is applied to the apparatus, it can be transmitted along a path including the first coupling end section 510A of the core unit 51, the middle sleeve 57, the second outer plate 60, the first tensioning elements 631, the first inner plate 55, the restraining unit 52, the second inner plate 56, the second tensioning elements 632, the first outer plate 59, and the outer sleeve 58. Subsequently, the force is transmitted out through the second coupling end section 510B of the core unit 51. Hence, the first outer plate 59 is separated from the middle sleeve 57, the second outer plate 60 is separated from the outer sleeve 58, and relative movement occurs among the middle sleeve 57, the restraining unit 52, and the outer sleeve 58, such that the length of each of the first and second tensioning elements 631, 632 is increased by an amount δ. As a result, the middle sleeve 57 and the outer sleeve 58 are moved relative to each other by a distance 2δ, and the length of the core unit 31 is reduced by an amount 2δ.

During this procedure, the core unit 51 can dissipate the earthquake energy by compression of the energy dissipating section 510C, and the restraining unit 52 can prevent the core unit 51 from buckling. In this embodiment, since the first and second inner plates 55, 56 are welded respectively to two ends of the restraining unit 52, the restraining unit 52 bears against a lateral force generated due to buckling of the energy dissipating section 510C, and is clamped between the first and second inner plates 55, 56.

Figure 22:
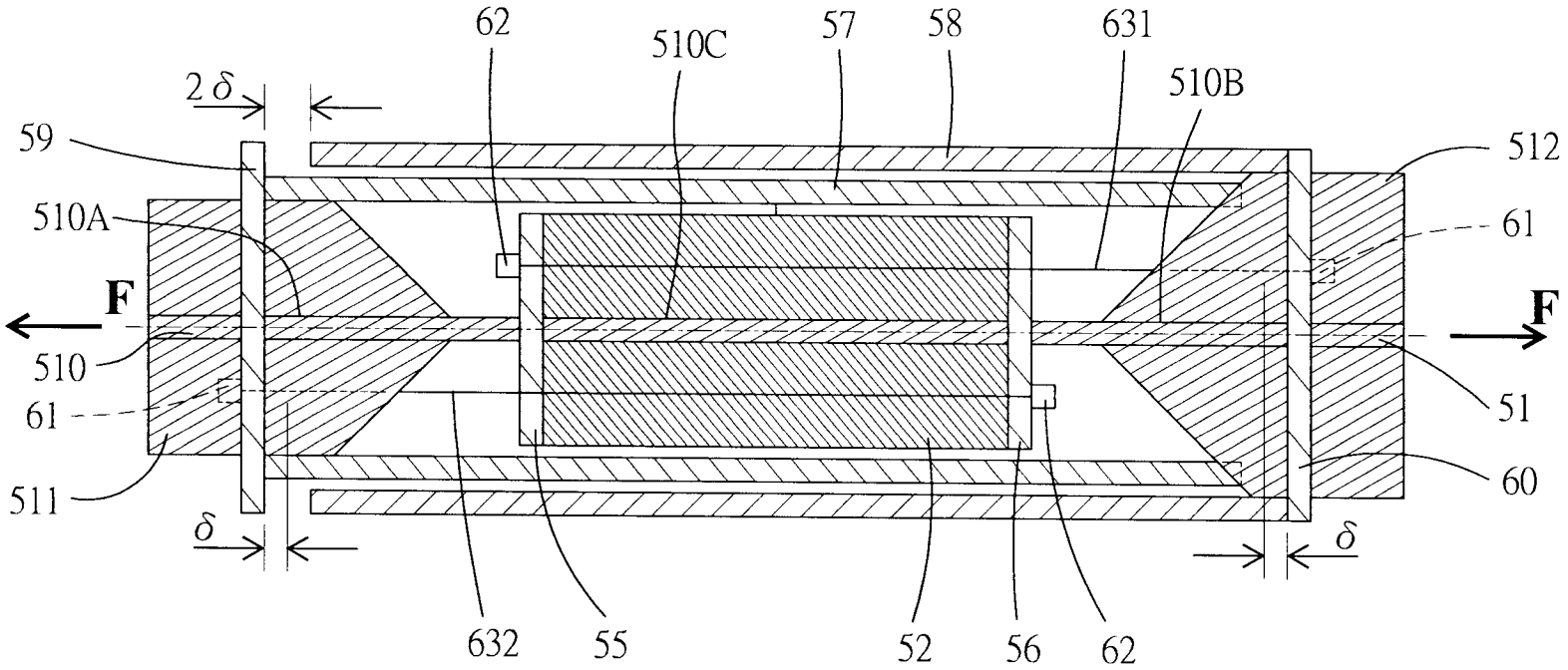

With particular reference to FIGS. 14 and 22, when a pulling force is applied to the apparatus, it can be transmitted along a path including the first coupling end section 510A of the core unit 51, the first outer plate 59, the second tensioning elements 632, the second inner plate 56, the restraining unit 52, the first inner plate 55, the first tensioning elements 631, the second outer plate 60, and the outer sleeve 58. The force is transmitted out through the second coupling end section 510B of the core unit 51. Hence, the first outer plate 59 is separated from the outer sleeve 58, the second outer plate 60 is separated from the middle sleeve 57, and relative movement occurs among the middle sleeve 57, the restraining unit 52, and the outer sleeve 58, so that the core unit 51 can dissipate the earthquake energy by tension of the energy dissipating section 510C, and the restraining unit 52 can prevent the core unit 51 from buckling. During this procedure, the length of each of the first and second tensioning elements 631, 632 is increased by an amount δ. As a result, the middle sleeve 57 and the outer sleeve 58 are moved relative to each other by a distance 2δ, and the length of the core unit 51 is increased by an amount 2δ.

Figure 23:
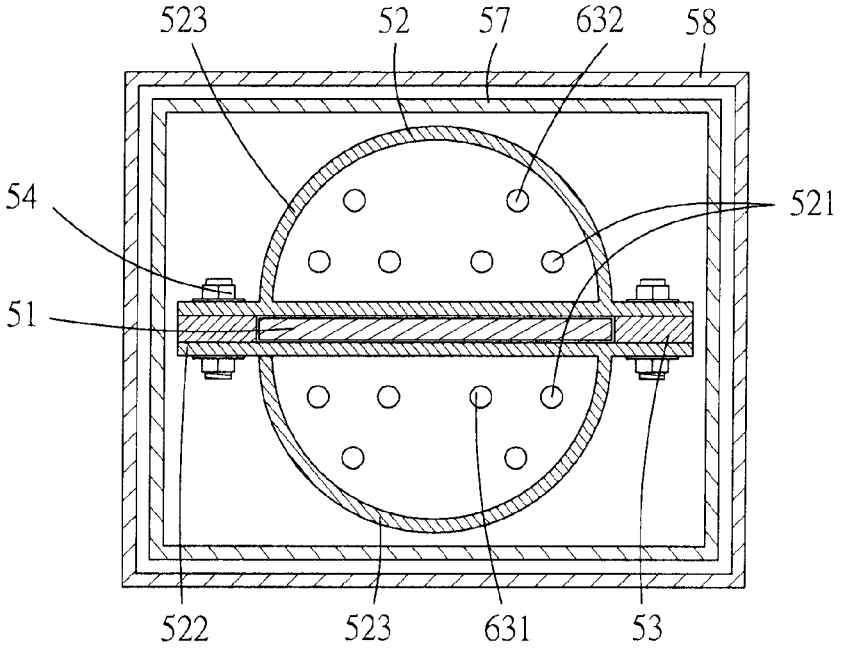
FIG. 23 is a sectional view of the fifth preferred embodiment of a dual-core self-centering energy dissipating apparatus according to this invention.

FIG. 23 shows the fifth preferred embodiment of a dual-core self-centering buckling-restrained brace according to this invention, which differs from the fourth preferred embodiment in that, the each of the channel members 523 of the restraining unit 52 has a semicircular cross-section, and is embedded with a plurality of rigid tubes 521 permitting the first and second tensioning elements 631, 632 to extend respectively therethrough.

Figure 24:
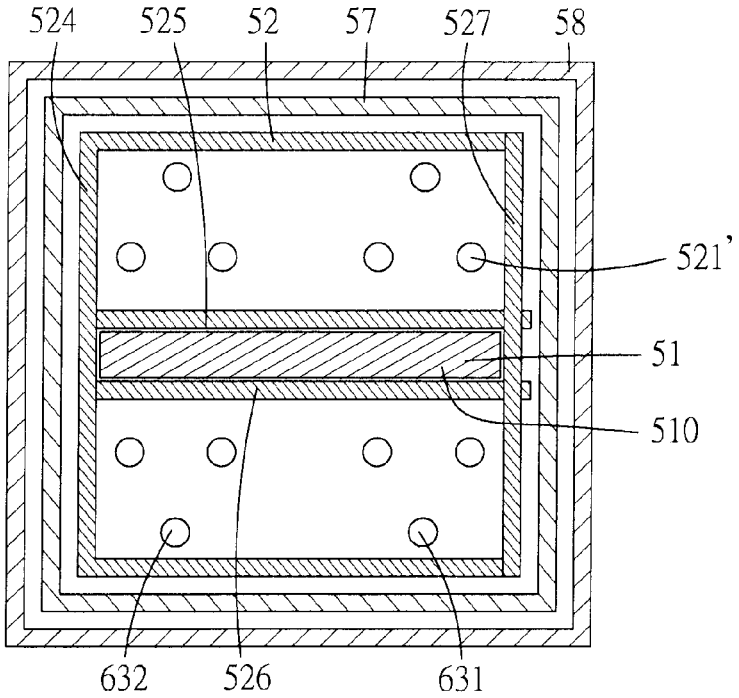
FIG. 24 is a sectional view of the sixth preferred embodiment of a dual-core self-centering energy dissipating apparatus according to this invention.

FIG. 24 shows the sixth preferred embodiment of a dual-core self-centering buckling-restrained brace according to this invention, which is similar to the fourth preferred embodiment. Unlike the fourth preferred embodiment, the restraining unit 52 includes a channel member 524 having a rectangular cross-section and permitting the core unit 51 to be disposed therein, two steel plates 525, 526 abutting respectively against top and bottom surfaces of the main body 510 and each having an inner end (i.e., left end) welded to an inner surface of the channel member 524, and an outer end (i.e., right end) extending outwardly from an right end opening in the channel member 524, and a cover plate 527 sealing the opening in the channel member 524. As such, the core unit 51 is clamped between the steel plates 525, 526. The cover plate 527 is formed with two slots permitting the outer ends of the steel plates 525, 526 to extend therethrough, and is welded to the steel plates 525, 526 and the channel member 524. Similar to the fourth preferred embodiment, the channel member 524 can be filled with cement paste or concrete, and embedded with a plurality of rigid tubes 521' permitting the first and second tensioning elements 631, 632 to extend respectively therethrough.

To sump up, energy can be dissipated by the energy dissipating section 310C, 510C of the core unit 31, 51, and buckling of the core unt 31, 51 can be minimized by the restraining unit 32, 52. Thus, the object of this invention is achieved.

With this invention thus explained, it is apparent that numerous modifications and variations can be made without departing from the scope and spirit of this invention. It is therefore intended that this invention be limited only as indicated by the appended claims.

We claim:

1. A buckling-restrained brace adapted to be mounted to a building, said buckling-restrained brace comprising:

an elongate core unit including a main body having opposite first and second coupling end sections adapted to connect with the building, and an energy dissipating section connected between said first and second coupling end sections;

a restraining unit including two steel plates clamping said energy dissipating section of said main body of said core unit therebetween, and at least one channel member connected to said steel plates;

a middle sleeve disposed around said energy dissipating section of said main body and having an end welded to said first coupling end section of said main body;

an outer sleeve disposed around said energy dissipating section of said main body, said restraining unit, and said middle sleeve, said outer sleeve having two ends aligned respectively with two ends of said middle sleeve, one of said ends of said outer sleeve being welded to said second coupling end section of said main body;

first and second inner plates adjacent respectively to two ends of said restraining unit such that said restraining unit is disposed between said first and second inner plates;

first and second outer plates adjacent respectively to two ends of each of said middle and outer sleeves such that said middle and outer sleeves are disposed between said first and second outer plates;

at least one first tensioning element extending along a longitudinal direction of said core unit and fastened to said first inner plate at one end thereof, and to said second outer plate at the other end thereof; and at least one second tensioning element extending along the longitudinal direction of said core unit and fastened to said first outer plate at one end thereof, and to said second inner plate at the other end thereof;

wherein, when applied to said buckling-restrained brace, an external force is transmitted along one of two paths, and is transmitted out of said apparatus through said second coupling end section of said core unit, one of the paths including said first coupling end section of said core unit, said second outer plate, said first inner plate, said second inner plate, and said first outer plate, the other of the paths including said first coupling end section of said core unit, said first outer plate, said second inner plate, said first inner plate, and said second outer plate, transmission of the external force along either the first path or the second path resulting in elongation of each of said first and second tensioning elements by a distance δ, so that said middle and outer sleeves are moved relative to each other by a distance 2δ to change the length of said energy dissipating section of said main body by a distance 2δ, such that buckling of said core unit can be prevented by said restraining unit.

2. The buckling-restrained brace as claimed in claim 1, further comprising an inner sleeve disposed around said energy dissipating section of said main body and said restraining unit, said first and second inner plates being connected respectively to two ends of said inner sleeve such that, when said buckling-restrained brace is subjected to the external force, the external force is transmitted from said first inner plate to said second inner plate through said inner sleeve.

3. The buckling-restrained brace as claimed in claim 1, wherein said first and second inner plates are disposed between said first and second outer plates, each of said first and second inner plates being adjacent to a junction between said energy dissipating section and a corresponding one of said first and second coupling end sections of said core unit, each of said first inner plate and said first outer plate being formed with an accommodating space permitting said first coupling end section of said main body to extend therethrough, each of said second inner plate and said second outer plate being formed with an accommodating space permitting said second coupling end section of said main body to extend therethrough.

4. The buckling-restrained brace as claimed in claim 1, wherein each of said first and second coupling end sections of said main body has a middle portion and a uniform-width connecting portion connected to an end of said middle portion distal from said energy-dissipating section and in contact with and welded to a corresponding one of said middle and outer sleeves, said middle portion having a width that reduces gradually in a direction toward said energy dissipating section, said connecting portion having a width equal to the maximum width of said middle portion.

5. The buckling-restrained brace as claimed in claim 1, wherein each of said first and second coupling end sections of said main body has top and bottom surfaces, said core unit further including four reinforcing plates welded respectively to and perpendicular to said top and bottom surfaces of said first and second coupling end sections.

6. The buckling-restrained brace as claimed in claim 1, wherein said restraining unit includes two said channel members and a plurality of bolts, each of said channel members having an opening or a cross-section that is one of rectangular and semicircular, said channel members being opened toward each other and being welded respectively to said steel plates, said steel plates being interconnected fixedly by said bolts.

7. The buckling-restrained brace as claimed in claim 1, wherein said main body has top and bottom surfaces, and said restraining unit includes a channel member disposed around said core unit and having an opening, two steel plates abutting respectively against said top and bottom ends of said main body and having an inner end welded to said channel member and an outer end extending outwardly from said opening in said channel member, and a cover plate sealing said opening in said channel member, said cover plate being formed with two slots permitting said outer ends of said steel plates to extend therethrough, said cover plate being welded to said steel plates and said channel member.

8. The buckling-restrained brace as claimed in claim 2, wherein each of said inner and middle sleeves is configured as a steel tube, said middle sleeve being disposed around said inner sleeve.

9. The buckling-restrained brace as claimed in claim 5, wherein said first and second coupling end sections of said main body and said reinforcing plates are welded to said middle sleeve, said end of said middle sleeve being formed with a plurality of open-ended slots, said second coupling end section of said main body and two of said reinforcing plates that are welded to said second coupling end section of said main body extending respectively through said open-ended slots.

10. The buckling-restrained brace as claimed in claim 9, wherein said outer sleeve is configured as a steel tube, and said first coupling end section of said main body and two of said reinforcing plates welded to said first coupling end section are welded to said middle sleeve.

11. The buckling-restrained brace as claimed in claim 1, wherein said channel member is filled with one of cement paste or concrete.

12. The buckling-restrained brace as claimed in claim 1, wherein said first and second tensioning elements are made of a stretchable material selected from one group including a composite material fiber bar, a twisted steel wire, a steel bar, and an alloy bar.

* * * * *